US009064621B2

(12) United States Patent
Kodama et al.

(10) Patent No.: US 9,064,621 B2
(45) Date of Patent: Jun. 23, 2015

(54) PARALLEL FOAMED COAXIAL CABLE

(75) Inventors: Sohei Kodama, Hitachi (JP); Masafumi Kaga, Hitachi (JP); Akinari Nakayama, Hitachinaka (JP)

(73) Assignee: HITACHI METALS, LTD., Tokyo (JP)

( * ) Notice: Subject to any disclaimer, the term of this patent is extended or adjusted under 35 U.S.C. 154(b) by 207 days.

(21) Appl. No.: 13/617,157

(22) Filed: Sep. 14, 2012

(65) Prior Publication Data

US 2013/0180752 A1 Jul. 18, 2013

(30) Foreign Application Priority Data

Jan. 17, 2012 (JP) ..... 2012-006840

(51) Int. Cl.
*H01B 7/18* (2006.01)
*H01B 11/18* (2006.01)
*H01B 11/20* (2006.01)

(52) U.S. Cl.
CPC ..... *H01B 11/1882* (2013.01); *H01B 11/20* (2013.01)

(58) Field of Classification Search
CPC ..... H01B 7/18
USPC ..... 174/107, 115, 117
See application file for complete search history.

(56) References Cited

U.S. PATENT DOCUMENTS

| | | | | |
|---|---|---|---|---|
| 7,206,482 | B2 * | 4/2007 | Rhyne et al. | 385/113 |
| 8,575,488 | B2 * | 11/2013 | Sugiyama et al. | 174/105 R |
| 2010/0300725 | A1 * | 12/2010 | Nakayama et al. | 174/110 SR |

FOREIGN PATENT DOCUMENTS

| | | | |
|---|---|---|---|
| JP | 04-115419 | | 4/1992 |
| JP | 2001-035270 | | 2/2001 |
| JP | 2001035270 | * | 9/2001 |
| JP | 2003-141944 | | 5/2003 |

OTHER PUBLICATIONS

Japanese Office Action dated Jan. 6, 2015 and English translation of Notice of Reasons for refusal.

* cited by examiner

*Primary Examiner* — Timothy Thompson
*Assistant Examiner* — Charles Pizzuto
(74) *Attorney, Agent, or Firm* — Roberts Mlotkowski Safran & Cole P.C.

(57) ABSTRACT

A parallel foamed coaxial cable includes one or more pairs of inner conductors aligned in parallel, a foamed insulation covering together the inner conductors and having a cross sectional shape including an elliptical shape, a rounded-rectangular shape or a quasi-elliptical shape formed by combining a plurality of curved lines, a non-foamed skin layer covering the foamed insulation and having a maximum thickness in a major axis direction of the cross sectional shape of the foamed insulation and a minimum thickness in a minor axis direction of the cross sectional shape of the foamed insulation, an outer conductor covering the non-foamed skin layer, and an insulation jacket covering the outer conductor. The maximum thickness of the non-foamed skin layer is not less than 1% of a major axis of the cross sectional shape of the foamed insulation.

6 Claims, 14 Drawing Sheets

| | | ELLIPSE | OVAL |
|---|---|---|---|
| SCHEMATIC VIEW OF CROSS SECTION | |   |   |
| DISTANCE BETWEEN TWO CORES (mm) | | 1.00 ± 0.05 | |
| MAJOR AXIS (mm) | | 3.2 ± 0.1 | |
| MINOR AXIS (mm) | | 1.6 ± 0.1 | |
| FOAMING DEGREE (%) | FOAMED INSULATION | 50 to 60 | |
| | TOTAL (INCLUDING SKIN LAYER) | 45 to 60 | |

1 INNER CONDUCTOR
2 FOAMED INSULATION
3 NON-FOAMED SKIN LAYER

PARALLEL FOAMED COAXIAL CABLE

The present application is based on Japanese patent application No. 2012-006840 filed on Jan. 17, 2012, the entire contents of which are incorporated herein by reference.

BACKGROUND OF THE INVENTION

1. Field of the Invention

The invention relates to a parallel foamed coaxial cable and, in particular, a parallel foamed coaxial cable used in electronic devices such as computers.

2. Description of the Related Art

According to the increase in data transmission speed of electronic devices such as computers, cables used therein need to be adapted to a higher transmission rate. For example, in the application for differential transmission, as shown in FIG. 10, a two-core parallel cable is known as a conventional cable to meet such a need in which two insulated core wires 26 are arranged in parallel which are each formed by covering an inner conductor 21 with a foamed insulation 22 to have a circular cross section, an outer conductor 24 is disposed therearound, and an insulation jacket 25 is formed thereon.

Recently, in order to obtain a further high speed transmission rate, a low skew cable has been developed that has one or more pairs (one pair in FIGS. 11 and 12) of the inner conductor 21 aligned in parallel and covered together with the foamed insulation 22 as shown in FIGS. 11 and 12 (see JP-A-2001-35270).

SUMMARY OF THE INVENTION

If in the future the speed of data processing and transmission of electronic devices such as computers is further increased, the suppression of variation in delay time inside or between the pair and the decrease in skew are strongly demanded as well as the increase in transmission rate.

For example, by covering together the conductors 21 with the foamed insulation 22 as shown in FIGS. 11 and 12, unevenness in the foaming degree on the same cross section can be suppressed. However, the position in the parallel direction of the two cores may be unstable, which causes adverse effect on impedance. It is supposed that this is caused by a force (i.e., a force acting between the two cores as shown by an arrow A in FIG. 13) generated when the insulation between two cores of a pair of inner conductors 21 expands due to the foaming of the foamed insulation 22.

As a measure for suppressing such a problem, a method may be conceived that the shape of a foamed insulation 2 is fixed by covering the periphery of the foamed insulation 2 with a non-foamed skin layer 3 to impart a drag force (as shown by an arrow B) to suppress the expansion between two cores of a pair of inner conductors 1 as shown in FIG. 14. Thereby, the position of two inner conductors may be stabilized by forming the non-foamed skin layer 3. However, since the non-foamed skin layer 3 is not foamed, the thicker the non-foamed skin layer 3, the lower the foaming degree of the entire insulation even if the foamed insulation 2 is highly foamed. This can impede the improvement in delay time.

If the foaming degree of the entire insulation lowers, the cable diameter needs to be increased to obtain the same transmission characteristics. However, the increase in the cable diameter may cause an increase in the size of a connector device or a need to redesign a substrate thereof, thus an increase in manufacturing cost. Therefore, it is desired that the non-foamed skin layer 3 is formed as thin as possible. However, if the non-foamed skin layer 3 is constantly too thin, the drag force may not act sufficiently even though high foaming of the entire insulation can be achieved. Thus, it is likely to deform when receiving an expansion force or an external force in the process of foaming, so that the position of two cores in the parallel direction becomes unstable.

Accordingly, it is an object of the invention to provide a parallel foamed coaxial cable that can simultaneously achieve an increase in transmission rate and a reduction in skew.

(1) According to one embodiment of the invention, a parallel foamed coaxial cable comprises:

one or more pairs of inner conductors aligned in parallel;

a foamed insulation covering together the inner conductors and having a cross sectional shape comprising an elliptical shape, a rounded-rectangular shape or a quasi-elliptical shape formed by combining a plurality of curved lines;

a non-foamed skin layer covering the foamed insulation and having a maximum thickness in a major axis direction of the cross sectional shape of the foamed insulation and a minimum thickness in a minor axis direction of the cross sectional shape of the foamed insulation;

an outer conductor covering the non-foamed skin layer; and an insulation jacket covering the outer conductor, wherein the maximum thickness of the non-foamed skin layer is not less than 1% of a major axis of the cross sectional shape of the foamed insulation.

In the above embodiment (1) of the invention, the following modifications and changes can be made.

(i) The maximum thickness of the non-foamed skin layer is not less than 1% and less than 10% of the major axis of the cross sectional shape of the foamed insulation.

(ii) The coaxial cable has an impedance variation within 100±3Ω, and a skew of not more than 3 ps/m.

(iii) A foaming degree of the foamed insulation is 50 to 60%.

(iv) A foaming degree of the entire insulation comprising the foamed insulation and the non-foamed skin layer is 45 to 60%.

(v) The entire insulation comprising the foamed insulation and the non-foamed skin layer has a major axis within 3.2±0.1 mm and a minor axis within 1.6±0.1 mm.

EFFECTS OF THE INVENTION

According to one embodiment of the invention, a parallel foamed coaxial cable can be provided that can simultaneously achieve an increase in transmission rate and a reduction in skew. For example, the parallel foamed coaxial cable is constructed such that a non-foamed skin layer is formed on the foamed insulation with an elliptical shape, a rounded-rectangular shape or a quasi-elliptical shape, and that the thickness distribution (in the cross section) of the non-foamed skin layer is provided to have a maximum thickness in the major axis direction and a minimum thickness in the minor axis direction. Thereby, the parallel foamed coaxial cable can have a high foaming degree of not less than 45% and stabilize the distance between the two cores.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

A preferred embodiment of a parallel foamed coaxial cable in the invention will be described below.

Summary of the Embodiment

A parallel foamed coaxial cable of the invention is provided with one or more pairs of inner conductors aligned in parallel, a foamed insulation covering together the inner conductors and having a cross sectional shape including an elliptical shape, a rounded-rectangular shape or a quasi-elliptical shape formed by combining plural curved lines, a non-foamed skin layer covering the foamed insulation and having a maximum thickness in a major axis direction of the cross sectional shape of the foamed insulation and a minimum thickness in a minor axis direction of the cross sectional shape of the foamed insulation, an outer conductor covering the non-foamed skin layer, and an insulation jacket covering the outer conductor, wherein the maximum thickness of the non-foamed skin layer is not less than 1% of a major axis of the cross sectional shape of the foamed insulation.

Embodiment

Figure 1:
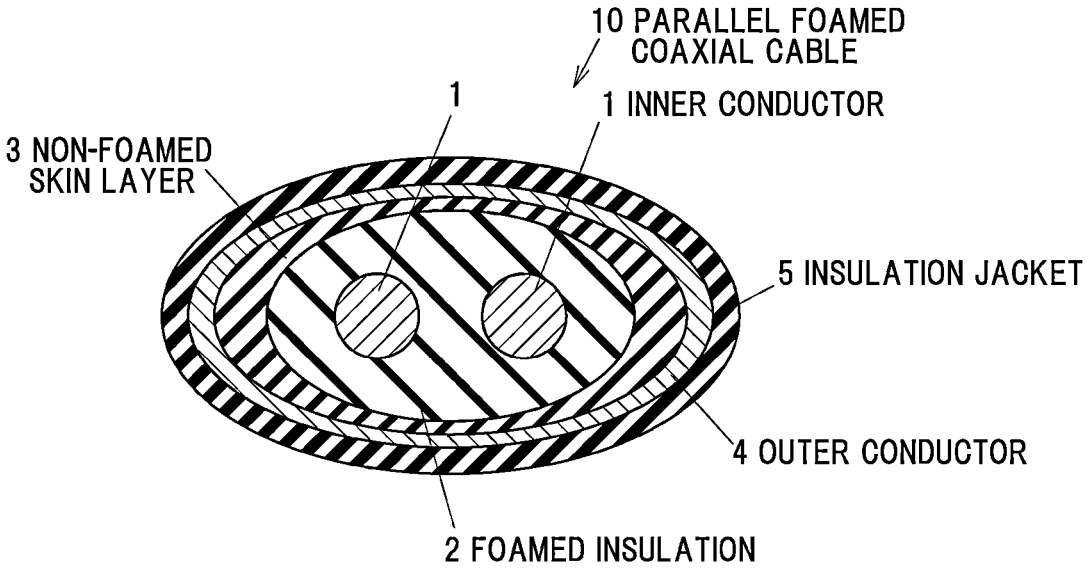
FIG. 1 is a schematic cross sectional view showing a parallel foamed coaxial cable (an elliptical cross section) in an embodiment of the present invention.
Figure 2:
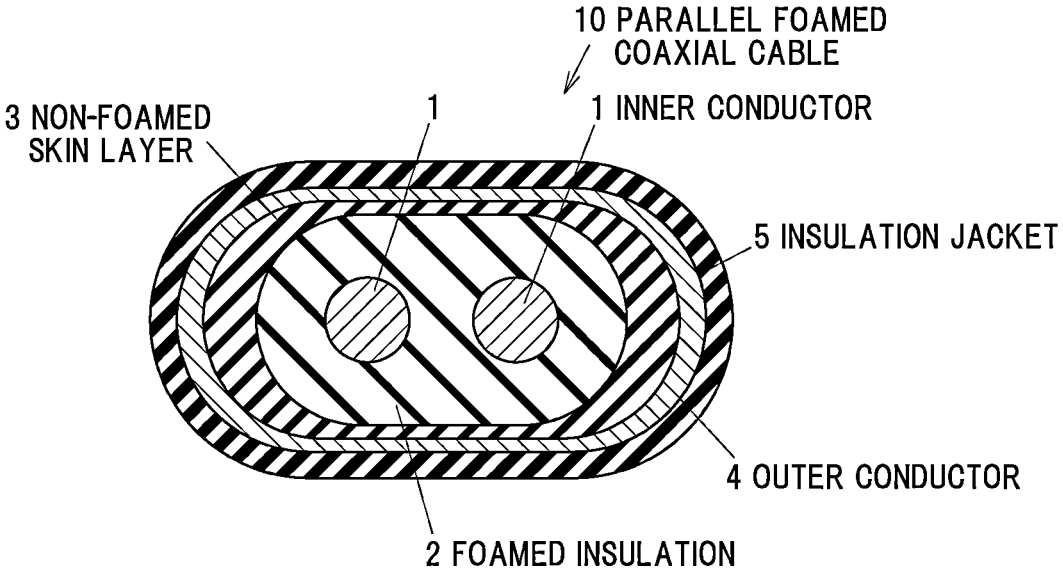
FIG. 2 is a schematic cross sectional view showing a parallel foamed coaxial cable (a rounded-rectangular cross section) in an embodiment of the invention.

As shown in FIGS. 1 and 2, a parallel foamed coaxial cable 10 in the present embodiment is provided with one or more pairs (one pair in FIGS. 1 and 2) of inner conductors 1 arranged side by side and extending in parallel, a foamed insulation 2 arranged to cover the inner conductors 1 all together and having a cross section in an elliptical shape, a rounded-rectangular shape or a quasi-elliptical shape formed by combining plural curved lines, a non-foamed skin layer 3 arranged to cover the foamed insulation 2 and having the maximum thickness present in a major axis direction of the cross section of the foamed insulation 2 and the minimum thickness present in a minor axis direction of the cross section of the foamed insulation 2, an outer conductor 4 arranged to cover the non-foamed skin layer 3 and an insulation jacket 5 arranged to cover the outer conductor 4.

As described above, in the parallel foamed coaxial cable 10 of the present embodiment, one or more pairs of inner conductors 1 extending in parallel are covered all together by the foamed insulation 2 having a cross section in an elliptical shape, a rounded-rectangular shape or a quasi-elliptical shape formed by combining a plurality of curved lines (including a combined shape thereof), the position of two cores is fixed by providing the non-foamed skin layer 3 around the foamed insulation 2, and furthermore, the non-foamed skin layer 3 is formed so that the thickness thereof is large only in a major axis direction of the foamed insulation 2 and is small in other portions, especially in a minor axis direction, thereby suppressing an extreme decrease in the foaming degree.

Figure 3:
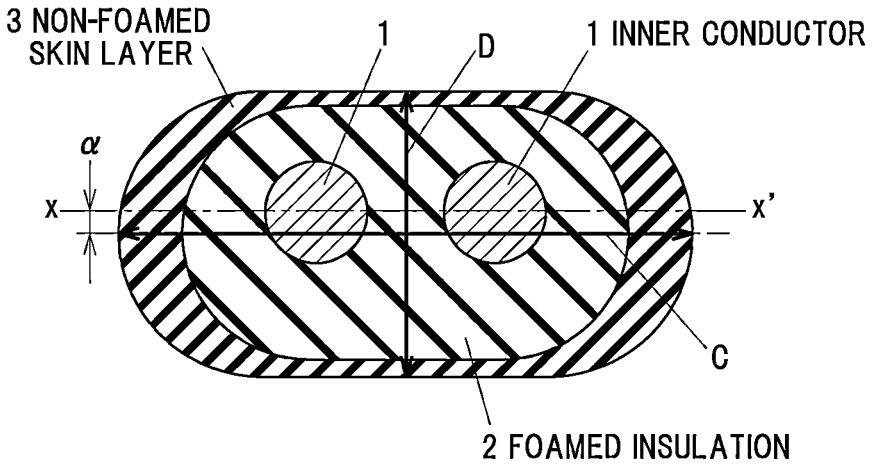
FIG. 3 is a cross sectional view when an offset a at a distance in a minor axis direction occurs between a major axis of a foamed insulation and a line x-x' connecting the centers of one or more inner conductors extending in parallel.
Figure 4:
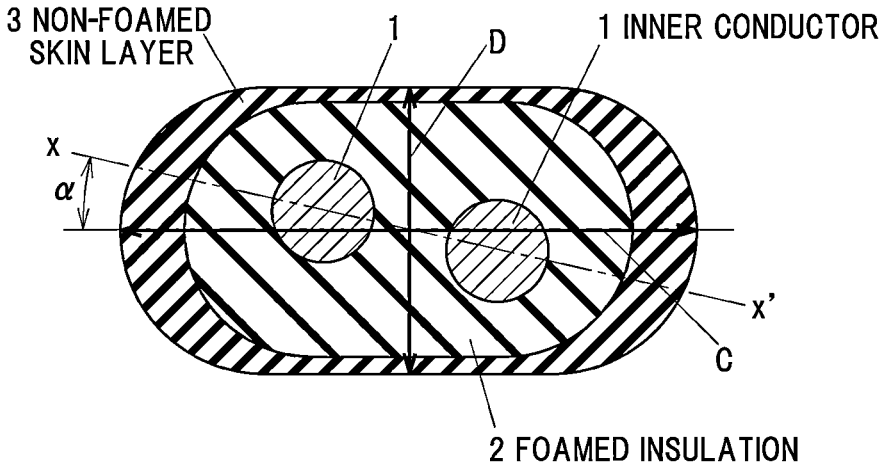
FIG. 4 is a cross sectional view when an offset a at an angle inclined centering around an intersection of a major axis and a minor axis occurs between the major axis of the foamed insulation and the line x-x' connecting the centers of one or more inner conductors extending in parallel.

As shown in FIGS. 3 and 4, it is preferable that a major axis C of the foamed insulation 2 be on a line connecting the centers of one or more pairs of inner conductors 1 extending in parallel and that the line x-x' connecting the centers pass through the center of a minor axis D of the foamed insulation 2 from the viewpoint of transmission characteristics and extrusion molding, however, an offset a from the line x-x' connecting the centers of two cores (FIG. 3 shows an offset at distance in a major axis direction and FIG. 4 shows an offset at an angle inclined centering around an intersection of the major axis C and the minor axis D) does not specifically cause a problem as long as occurring within a range not affecting transmission characteristics.

In the parallel foamed coaxial cable 10 in the present embodiment, it is preferable that skew be not more than 3 ps/m from the viewpoint of transmission characteristics and impedance be 100Ω with an error of±not more than 3Ω. If the position of the two inner conductors 1 is greatly offset from the target position, which is set to achieve such skew and impedance, during the process of manufacturing a cable, delay is increased and a satisfactory transmission rate is not obtained. Therefore, the offset of the two inner conductors 1 during the process of manufacturing a cable needs to be suppressed to not more than±0.05 mm from the target position.

The present embodiment will be described below for each component and required characteristic (condition).

Component

Inner Conductor

A material constituting the inner conductor 1 used in the present embodiment is not specifically limited, and it is possible to use copper, copper alloy, metal plated copper, aluminum and steel, etc., which are conventionally often used. In addition, the inner conductor 1 may be formed of a single solid strand or may be a stranded wire formed by twisting plural metal strands. Furthermore, the thickness of the inner conductor 1 is not specifically limited, neither, and practically, thickness of about No. 20 to 32 of American Wire Gauge (AWG) is often used.

Foamed Insulation

Although a foamed insulating material constituting the foamed insulation 2 used in the present embodiment is not specifically limited as long as having resistance to crushing and a low dielectric constant, it is preferable to use known expandable polymers excellent in extrudability and hardenability, etc., e.g., foamed thermoplastic polymers such as polyethylene (PE), fluorine ethylene propylene copolymer (FEP), perfluoroalkoxy copolymer (PFA), ethylene tetrafluoroethylene copolymer (ETFE) and polyolefin copolymer for the convenience of covering the inner conductors 1 all together by collective extrusion molding.

The cross sectional shape can be an elliptical shape, a rounded-rectangular shape (also called a track shape, an elongated circular shape or a rectangle with rounded corners) or a quasi-elliptical shape formed by combining plural curved lines (including a combined shape thereof).

A foaming method includes a chemical foaming method in which a foam nucleating agent such as azodicarboxylic amide (ADCA) or dinitroso-pentamethylene tetramine is thermally decomposed so that gas generated thereby is used as a foaming agent and a physical foaming method in which nitrogen gas or carbon dioxide, etc., is directly injected as a foaming agent, and both are available. It should be noted that, the foaming degree will be described later.

Non-Foamed Skin Layer

A material constituting the non-foamed skin layer 3 used in the present embodiment is not specifically limited as long as allowing extrusion molding and having a low dielectric constant in the same manner as the foamed insulation 2. In addition, since it is possible to suppress foam formation by designing the process such that the foaming gas or the foam nucleating agent is not added or the extrusion temperature is decreased or gas injection pressure is set to zero and a non-foamed solid layer can be thereby provided, it is possible to use the totally same material as the foamed insulation 2.

Since it is difficult to form the non-foamed skin layer 3 so as to have a drastically different thickness distribution due to technical characteristics of extrusion molding, it is preferable to employ a method in which the non-foamed skin layer 3 is continuously and gradually thinned such that a thickness in a major axis direction of a cross sectional shape of the foamed insulation 2 is the maximum thickness and a thickness in a minor axis direction of the cross sectional shape thereof is the minimum thickness, from the viewpoint of the production.

The thickness of the non-foamed skin layer 3 in the major axis direction of the foamed insulation 2 (the maximum thickness) is different depending on the size of the foamed insulation 2 and the size and shape of air bubbles, but needs to be not less than 1% of the major axis of the foamed insulation 2 in order to prevent leakage of foaming gas and to fix the position of the two cores in parallel. By adjusting the thickness of the non-foamed skin layer 3 in the major axis direction of the foamed insulation 2 (the maximum thickness) to be not less than 1% of the major axis of the foamed insulation 2 as described above, it is possible to suppress strain causing respective offsets of the two conductors in the major axis direction. However, since the too large maximum thickness decreases the foaming degree of the entire insulation and is unlikely to achieve a low dielectric constant, the preferred maximum thickness of the non-foamed skin layer 3 is less than 10% of the major axis of the foamed insulation 2, and more preferably, less than 6% of the major axis of the foamed insulation 2.

Meanwhile, since the non-foamed skin layer 3 is not foamed, the too thick non-foamed skin layer 3 decreases the foaming degree of the entire insulation as a combination of the foamed insulation 2 with the non-foamed skin layer 3 and increases a dielectric constant of the entire insulation, leading to an increase in delay time after forming a parallel coaxial cable. Therefore, especially the thickness of the non-foamed skin layer 3 in the minor axis direction of the foamed insulation 2 (the minimum thickness) which less affects stabilization of the two cores in a parallel direction should be as small as possible in order to improve the foaming degree.

In addition, the two cores are preferably arranged in parallel in the major axis direction of the foamed insulation 2 since it is easy to fix the position thereof.

Figure 5:
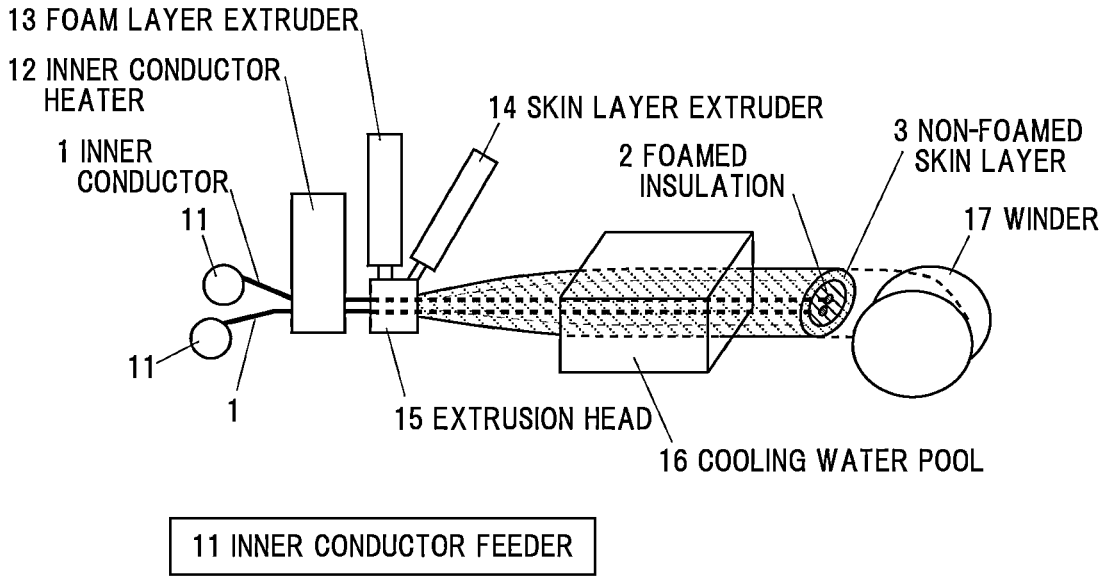
FIG. 5 is a schematic explanatory diagram illustrating a covering process (extrusion process) of a foamed insulation and a non-foamed skin layer.

A covering process of the foamed insulation 2 and the non-foamed skin layer 3 is the same as a typical extrusion process except that two inner conductor feeders 11 are arranged in parallel as shown in FIG. 5.

The inner conductors 1 fed from the inner conductor feeders 11 are arranged in parallel and are heated in an inner conductor heater 12. Adhesion between the foamed insulation 2 and the inner conductors 1 is enhanced by heating the inner conductors 1 and it is thereby possible to suppress separation.

Subsequently, a foamed insulating material and a skin layer material fed from a foam layer extruder 13 and a skin layer extruder 14 are extruded from an extrusion head 15 to cover the periphery of the inner conductors 1. Here, the foamed insulation 2 is foamed by being released into the atmospheric pressure environment after coming out from the head.

At this time, since the foamed insulation 2 and the non-foamed skin layer 3 are extruded together on the inner conductors 1, the foaming degree of the foamed insulation 2 can be kept high by the non-foamed skin layer 3 which can prevent leakage of foaming gas generated in or injected into the foamed insulation 2, and in addition to this, in the present embodiment, the offset between the inner conductors 1 caused by foam formation is suppressed by forming the non-foamed skin layer to have the maximum thickness only in the major axis direction of the foamed insulation 2 and it is thus possible to stably maintain the distance between the inner conductors 1 as described above.

After that, the foamed insulation 2 and the non-foamed skin layer 3 are cooled in a cooling water pool 16 and are taken up by a winder 17.

Outer Conductor

A material constituting the outer conductor 4 used in the present embodiment is not specifically limited. It is possible to use a metal strand formed of copper, copper alloy, metal plated copper, aluminum and steel, etc., which are conventionally often used in the same manner as the inner conductor 1, and the outer conductor 4 is formed by braiding the metal strand so as to have a uniform thickness and to cover the foamed insulation 2 and the non-foamed skin layer 3. Alternatively, a served metal tape may be used as the outer conductor 4.

Insulation Jacket

A material constituting the insulation jacket 5 used in the present embodiment is not specifically limited as long as it is a polymer having a high dielectric power and electrical insulating properties as well as high tensile strength, good abrasion resistance and flame retardancy, etc., and it is preferable to use, e.g., polyvinyl chloride (PVC), polyvinyl chloride compound or fluorine ethylene propylene copolymer (FEP), etc.

Required Characteristics (Conditions)

Skew and Impedance

As described above, it is preferable that the parallel foamed coaxial cable in the present embodiment have skew of not more than 3 ps/m and impedance of 100 Ω.

Figure 6:
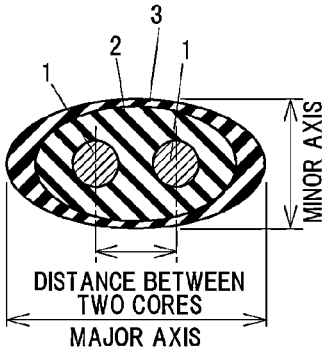
FIG. 6 is an explanatory diagram illustrating tolerance, etc., for distance between two conductors and for a positional offset of the conductors in a case that a structure of a parallel foamed coaxial cable is designed to be elliptical or rounded-rectangular in cross section.
Figure 6:
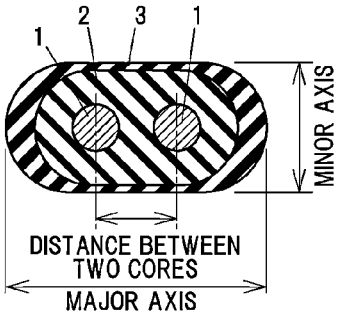

Distance Between Two Conductors and Tolerance for Positional Offset of Conductors A structure of the parallel coaxial cable is designed using materials shown in Table 1. That is, by using a silver-plated copper wire (product name: 24AWG (0.511 mm in diameter), from Sanshu-Densen KK) as an inner conductor, 50 parts by mass of high-density polyethylene (product name: 6944, from Dow Chemical Co.), 50 parts by mass of low-density polyethylene (product name: B028, from Ube Industries, Ltd.) and 1 part by mass of nucleating agent (product name: ADCA, from Eiwa Chemical Ind. Co., Ltd.) as the foamed insulation 2, high-density polyethylene (product name: 6944, from Dow Chemical Co.) as the non-foamed skin layer 3 and a copper tape (15 nm in thickness, including 6 nm of PET) as an outer conductor, a structure of the parallel coaxial cable is designed so that skew is not more than 3 ps/m and impedance is 100Ω. The resulting structure is as shown in FIG. 6. A target distance between the two conductors is 1.00 mm, and tolerance for the positional offset of the conductors within a range not affecting transmission characteristics is ±0.05 mm. It should be noted that, major axis (mm) and minor axis (mm) in FIG. 6 indicate a major axis (mm) and minor axis (mm) of the cross section of the entire insulation composed of the foamed insulation 2 and the non-foamed skin layer 3 including the inner conductor 1.

TABLE 1

| | Materials |
|---|---|
| Inner conductor | Silver-plated copper wire (product name: 24AWG (0.511 mm in diameter), from Sanshu-Densen KK) |
| Foamed insulation | 50 parts by mass of high-density polyethylene (product name: 6944, from Dow Chemical Co.)<br>50 parts by mass of low-density polyethylene (product name: B028, from Ube Industries, Ltd.)<br>1 part by mass of nucleating (product name: ADCA, from Eiwa Chemical Ind. Co., Ltd.) |
| Non-foamed skin layer | High-density polyethylene (product name: 6944, from Dow Chemical Co.) |
| Outer conductor | Copper tape (15 μm in thickness, including 6 μm of PET) |

Foaming Degree: Foamed Insulation

It is preferable that the foaming degree of the foamed insulation 2 be 50 to 60%. That is, although the higher foaming degree is more preferable in order to decrease a dielectric constant of the foamed insulation 2, large air bubbles (which are called blowhole) are generated near the core when targeting not less than 60% of the foaming degree and causes separation from the inner conductor 1, hence, the target is set to 50 to 60%.

Foaming Degree: Entire Insulation Composed of the Foamed Insulation and the Non-Foamed Skin Layer It is preferable that the foaming degree of the entire insulation composed of the foamed insulation 2 and the non-foamed skin layer 3 be 45 to 60%. Not less than 45% is preferable for a specific gravity and a decrease in a dielectric constant from the viewpoint of the transmission characteristics of the cable, and the upper limit of the foaming degree of the entire insulation is preferably 60% by taking into consideration the upper limit of the foaming degree of the foamed insulation 2 which is set to 60% and mechanical strength of the insulation. The reason why the lower limit is lower than the target foaming degree of the foamed insulation 2 is that the foaming degree of the entire insulation inevitably becomes low since the non-foamed skin layer 3 is included.

Diameter: Total Diameter of Inner Conductors and Entire Insulation Composed of the Foamed Insulation and the Non-Foamed Skin Layer As for the total diameter of the inner conductors and the entire insulation composed of the foamed insulation 2 and the non-foamed skin layer 3, a major axis is 3.2±0.1 mm and a minor axis of 1.6±0.1 mm by taking into consideration transmission characteristics, the size of connector and the conditions such as 50% to 60% of the foaming degree of the foamed insulation 2 and 45% to 60% of the foaming degree of the entire insulation. It should be noted that, the shape may be any of an elliptical shape, a rounded-rectangular shape or a quasi-elliptical shape formed by combining plural curved lines (including a combined shape thereof) as long as the target is satisfied.

Extrusion Conditions

The extrusion conditions are shown in Table 2. That is, when the extrusion conditions of the foam layer extruder 13 was examined, it was found that the satisfactory foamed insulation 2 having the foaming degree of 55% is obtained when fixing a screw speed at 20 rpm and a cylinder temperature at 220° C. It should be noted that a chemical foaming method is used here, and thus, gas is not injected. Next, for the non-foamed skin layer, a die diameter of the skin layer extruder 14 is changed (an ellipse of 3 mm/1.5 mm, an ellipse of 3 mm/1.6 mm and a rounded-rectangle of 3 mm/1.5 mm: dimensions in major axis direction/minor axis direction) and the screw speed is also changed from 0 rpm to 10 rpm in order to vary the thickness of the non-foamed skin layer 3. The screw speed is 20 rpm for the foamed insulation 2 and 0 to 10 rpm for the non-foamed skin layer 3, the extrusion temperature is 220° C. and a wire feed rate is 50 to 60 m/min.

EXAMPLES

Although the parallel foamed coaxial cable 10 in the invention will be described more in detail below in reference to Examples, the invention is not limited thereto.

Example 1

The constituent materials shown in Table 1 were used. That is, a silver-plated copper wire (product name: 24AWG (0.511 mm in diameter), from Sanshu-Densen KK) was used as an inner conductor, 50 parts by mass of high-density polyethylene (product name: 6944, from Dow Chemical Co.), 50 parts by mass of low-density polyethylene (product name: B028, from Ube Industries, Ltd.) and 1 part by mass of nucleating agent (product name: ADCA, from Eiwa Chemical Ind. Co., Ltd.) were used as the foamed insulation, high-density polyethylene (product name: 6944, from Dow Chemical Co.) was used as the non-foamed skin layer and a copper tape (15 μm in thickness, including 6 μm of PET) was used as an outer conductor.

The extrusion conditions are shown in Table 2. That is, when a foamed insulation was made by a chemical foaming method at a screw speed fixed at 20 rpm and a cylinder temperature fixed at 220° C. (without gas injection), a foamed insulation having the foaming degree of about 55% with a good elliptical cross section was obtained. For the non-foamed skin layer, the die diameter of the skin layer extruder was set to 3 mm/1.5 mm (major axis direction/minor axis direction) of an elliptical shape and the screw speed was set to 10 rpm. The screw speed was 20 rpm for the foamed insulation and 0 to 10 rpm for the non-foamed skin layer, the extrusion temperature was 220° C. and the wire feed rate was 50 to 60 m/min

TABLE 2

| | | |
|---|---|---|
| Screw speed | Foamed insulation | 20 rpm |
| | Non-foamed skin layer | 0 to 10 rpm |
| Extrusion temperature | | 220° C. |
| Wire feed rate | | 50 to 60 m/min |

As a result, an object having inner conductors, a foamed insulation and a non-foamed skin layer as shown in Table 3 was obtained. In other words, inner conductors with a distance between two cores of 1.004 mm, a foamed insulation in an elliptical shape with a major axis of 2.994 mm and a minor axis of 1.556 mm and having the forming degree of 54.2%, and a non-foamed skin layer having the maximum thickness of 0.135 mm which is 4.5% of the major axis of the foamed insulation and the minimum thickness of 0.035 mm were obtained, where the entire insulation composed of the foamed insulation and the non-foamed skin layer has a major axis of 3.264 mm and a minor axis of 1.626 mm. Subsequently, a sample of 1000 m was taken and was covered by an outer conductor and an insulation jacket.

ness of the non-foamed skin layer was varied by changing the die diameter of the skin layer extruder 14 and the screw speed. After obtaining objects having the inner conductors, the foamed insulation and the non-foamed skin layer shown in Table 3, samples of 1000 m were taken and were each covered by the outer conductor and the insulation jacket.

Evaluation

For evaluation, twenty 1-meter cables were taken from each sample at an interval of 50 m, and electrical characteristics and the foaming degree thereof were measured.

(1) Foaming Degree (Foamed Insulation)

The forming degree of the foamed insulation alone was measured using alcohol specific gravity. In this case, the preferred foaming degree is 50 to 60%.

(2) Foaming Degree (Entire Insulation Composed of the Foamed Insulation and the Non-Foamed Skin Layer)

The forming degree of the entire insulation composed of the foamed insulation and the non-foamed skin layer was measured using alcohol specific gravity. In this case, the preferred foaming degree is 45 to 60%.

(3) SEM Observation

As for the major and minor axes of the foamed insulation, the thickness of the non-foamed skin layer and the major and minor axes of the entire insulation, the cross sections of the twenty 1-meter samples were observed by SEM and measured using an image processing software (WinROOF), and each average value was derived.

(4) Comprehensive Judgment

TABLE 3

| | | | *Ex. 1 | Ex. 2 | Ex. 3 | Ex. 4 | Ex. 5 | Ex. 6 | Ex. 7 | *Comp. Ex. 1 | Comp. Ex. 2 | Comp. Ex. 3 | Comp. Ex. 4 |
|---|---|---|---|---|---|---|---|---|---|---|---|---|---|
| Setting of inner conductor | | Distance between two cores (mm) | 1.000 | 1.000 | 1.000 | 1.000 | 1.000 | 1.000 | 1.000 | 1.000 | 1.000 | 1.000 | 1.000 |
| Foamed insulation | | Shape | elliptic | elliptic | elliptic | elliptic | *RR | RR | elliptic | elliptic | elliptic | elliptic | elliptic |
| | | Major axis (mm) | 2.994 | 3.022 | 3.077 | 2.931 | 3.004 | 3.073 | 2.654 | 3.123 | 3.001 | 3.108 | 3.112 |
| | | Minor axis (mm) | 1.556 | 1.565 | 1.573 | 1.549 | 1.572 | 1.568 | 1.427 | 1.505 | 1.424 | 1.569 | 1.572 |
| | | Foaming degree (%) | 54.2 | 54.2 | 54.3 | 54.3 | 54.1 | 54.2 | 54.3 | 44 | 54.2 | 54.2 | 54.3 |
| Non-foamed skin layer | | Die: major axis (mm)/ minor axis (mm), Shape of die | 3/1.5 elliptic | 3/1.5 elliptic | 3/1.5 elliptic | 3/1.5 elliptic | 3/1.5 RR | 3/1.5 RR | 3/1.5 elliptic | 3/1.5 elliptic | 3/1.6 elliptic | 3/1.6 elliptic | 3/1.5 elliptic |
| | | Screw speed (rpm) | 10 | 7 | 4 | 12 | 9 | 4 | 15 | 0 | 9 | 2 | 2 |
| | | Maximum thickness (mm) | 0.135 | 0.101 | 0.05 | 0.162 | 0.125 | 0.06 | 0.289 | — | 0.121 | 0.028 | 0.025 |
| | | Ratio to major axis of foamed insulation (%) | 4.5 | 3.3 | 1.6 | 5.5 | 4.2 | 2 | 10.9 | — | 4 | 0.9 | 0.8 |
| | | Minimum thickness (mm) | 0.035 | 0.02 | 0.01 | 0.049 | 0.03 | 0.03 | 0.111 | — | 0.121 | 0.028 | 0.01 |
| Entire insulation | | Major axis (mm) | 3.264 | 3.224 | 3.177 | 3.255 | 3.254 | 3.193 | 3.232 | 3.123 | 3.243 | 3.164 | 3.162 |
| | | Minor axis (mm) | 1.626 | 1.605 | 1.593 | 1.647 | 1.632 | 1.628 | 1.649 | 1.505 | 1.664 | 1.623 | 1.592 |
| | | Foaming degree of entire insulation (%) | 46.9 | 49 | 51.7 | 45.1 | 47.2 | 49.4 | 36.9 | 44 | 41.7 | 51.2 | 52.6 |
| Parallel foamed coaxial cable | Inner conductor | Distance between two cores (mm) | 1.004 | 1.011 | 1.024 | 1.002 | 1.002 | 1.027 | 0.998 | 1.142 | 0.996 | 1.134 | 1.101 |
| | | Judgment (○ for 1.00 with an error of ± within 0.05) | ○ | ○ | ○ | ○ | ○ | ○ | ○ | X | ○ | X | X |
| | Variation in impedance | Criteria for passing the test: 100 with an error of ± not more than 3 Ω | ±1 | ±1 | ±2 | ±1 | ±1 | ±2 | ±1 | ±5 | ±1 | ±5 | ±4 |
| | Skew | Criteria for passing the test: not more than 3 ps/m | 2 | 1 | 2 | 1 | 1 | 2 | 1 | 3 | 1 | 3 | 3 |
| Comprehensive judgment | | | ○ | ○ | ○ | ○ | ○ | ○ | Δ | X | X | X | X |

*Ex.: Example, Comp. Ex.: Comparative Example, RR: rounded-rectangular

Examples 2 to 7 and Comparative Examples 1 to 4

Examples 2 to 7 and Comparative Examples 1 to 4 were made in the same manner as Example 1 except that the thick- The samples, in which the distance between the two cores of the inner conductors (judged as "○ (good)" when 1.00 with an error of within ±0.05), the non-foamed skin layer with a distributed thickness having the maximum thickness in the major axis direction of the foamed insulation and the minimum thickness in the minor axis direction, variation in impedance (regarded as "passed the test" when 100 with an error of ±not more than 3Ω) and skew (regarded as "passed the test" when not more than 3 ps/m) are all within the target range, were regarded as "passed the test" ("Δ (acceptable)" or better result). Among the samples which are regarded as "passed the test" in the comprehensive judgment, the samples which have the entire insulation having the foaming degree of not less than 45% and are likely to achieve a low dielectric constant are indicated by "○ (good)" in the comprehensive judgment.

As understood from Table 3, in Examples 1 to 7 and Comparative Examples 1 to 4, it was confirmed that a foamed insulation having the foaming degree of about 54%, which is within the target, is obtained by extruding the foamed insulation under the extrusion conditions shown in Table 2. In case of, e.g., Example 1, since the periphery of the foamed insulation was covered with the non-foamed skin layer having the maximum thickness of 0.135 mm (4.5%, which is not less than 1%, of the major axis of the foamed insulation) and the minimum thickness of 0.035 mm, the target of the foaming degree of the foamed insulation was achieved as described above, the distance between the two conductors was only +0.004 mm more than the target and could fall within the target range. In addition, the entire foaming degree reached 46.9% which is within the target range, and it was confirmed that variation in impedance and skew of the cable are also excellent.

In Comparative Example 1, since the extrusion molding was carried out without a non-foamed skin layer, the foaming degree of the foamed insulation did not reach the target value of 50%. It is presumed that this is because foaming gas leaks from a surface of the foamed insulation at the time of foam formation since a skin layer is not provided on an outer periphery of the foamed insulation, resulting in a decrease in the foaming degree. In addition, stress A causing an offset of the two conductors could not be suppressed since the non-foamed skin layer was not provided, and accordingly, the distance between the two cores was +0.142 mm more than the target, which is out of the target range.

In Comparative Example 2 which is the sample covered by a non-foamed skin layer not having a distributed thickness and of 0.121 mm throughout the thickness, the stress A causing an offset of the conductors in the major axis direction was suppressed and the distance between the two cores was within the target range since a relatively thick non-foamed skin layer was formed. However, the thick non-foamed skin layer increases a ratio of a non-foamed portion to the entire insulation, and as a result, the foaming degree of the entire insulation was reduced as compared to Example 5 which is close to Comparative Example 2 in the maximum thickness. Furthermore, due to the skin layer without the distributed thickness, the cable is difficult to bend in the minor axis direction. Thus, since it has little utility, it is judged as "X (no good)" in the comprehensive judgment. From the result of Comparative Example 2, it is proved that the distributed thickness is needed in terms of the flexibility of the cable.

In Comparative Example 3 which is the sample covered by a thin non-foamed skin layer not having a distributed thickness and of 0.028 mm throughout the thickness in the opposite way to Comparative Example 2, although the foaming degree of the foamed insulation and that of the entire insulation were within the target value, it was not possible to suppress the stress A causing an offset of the conductors in the major axis direction since the non-foamed skin layer was thin (less than 1% of the major axis of the foamed insulation) and did not have a distributed thickness, and accordingly, the distance between the two cores was +0.134 mm more than 1.00 mm as the target in the major axis direction and variation in impedance was also large since the offset of the conductors could not be suppressed, hence, it is judged as "X".

In Examples 2 and 3, the foaming degree of the entire insulation increases when the maximum thickness is gradually reduced (thinned) from 0.135 mm of Example 1 (i.e., when a ratio (%) with respect to the major axis of the foamed insulation (the thickness in the major axis direction) is gradually reduced), however, a force suppressing the offset of the conductors tends to gradually decrease as the non-foamed skin layer in the major axis direction becomes thinner. In Comparative Example 4, although the non-foamed skin layer is formed to be thicker in the major axis direction than in the minor axis direction, it is not possible to suppress the stress A when the maximum thickness of the non-foamed skin layer (the thickness in the major axis direction) is below 1% of the major axis of the foamed insulation, and thus, the distance between the two cores is more than the target. That is, since the non-foamed skin layer is not formed (the foaming degree of 0%), the portion of the non-foamed skin layer in the major axis direction is preferably formed as thin as possible even though it is necessary to be thicker than the portion in the minor axis direction in order to suppress the offset of the conductors in the same manner that it is preferable that the non-foamed skin layer, except the portion in the major axis direction which is formed to be thick to some extent in order to suppress the offset of the conductors, be formed to be thin to the extent of at least preventing leakage of foaming gas in order to achieve the target of the foaming degree of the entire insulation (45 to 60%) as described above, however, the above-mentioned problems occur in the case of forming too thin.

In Example 7, since the thickness of the non-foamed skin layer in the major axis direction is 10.9% of the major axis of the foamed insulation and the non-foamed skin layer has a distributed thickness, the offset of the conductors is suppressed and both of variation in impedance and skew are within an acceptable range. Although the foamed insulation per se has a high foaming degree of 54.3%, the entire insulation has a slightly low foaming degree of 36.9%, hence, the comprehensive judgment is "Δ (acceptable)". That is, the invention aims to prevent the offset between the two conductors by forming the non-foamed skin layer so that the thickness in the major axis direction is greater than that in the minor axis direction to provides a distributed thickness, and while the thickness in the major axis direction is preferably not less than 1% of the major axis of the foamed insulation, it is preferable to be less than 10% of the major axis of the foamed insulation since the non-foamed skin layer having a too large thickness in major axis direction decreases the foaming degree of the entire insulation.

Examples 5 and 6 are parallel foamed coaxial cables having a rounded-rectangular insulation. It was confirmed that the same effects as Examples 1 to 4 having an elliptical shape are obtained when the non-foamed skin layer is formed within a range defined in the invention in the same manner as Examples 1 to 4.

Figure 7:
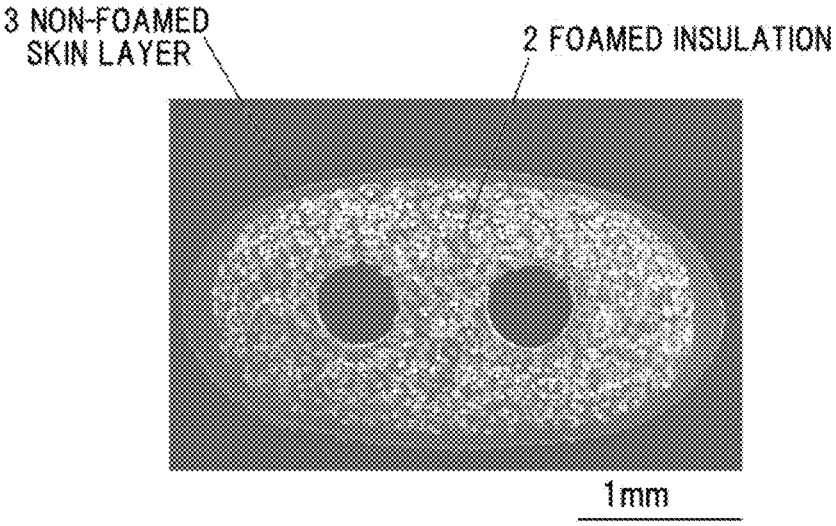
FIG. 7 is an SEM image showing a cross section of the entire insulation composed of the elliptical foamed insulation and the non-foamed skin layer manufactured in Example 1.
Figure 8:
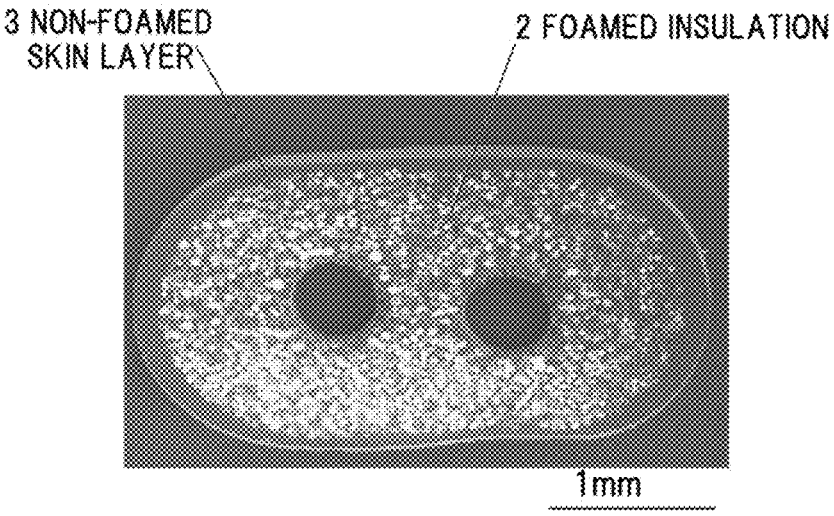
FIG. 8 is an SEM image showing a cross section of the entire insulation composed of the rounded-rectangular foamed insulation and the non-foamed skin layer manufactured in Example 5.

FIGS. 7 and 8 show cross-sectional SEM images of the manufactured entire insulation composed of the foamed insulation and the non-foamed skin layer having an elliptical shape (Example 1) and of the entire insulation having a rounded-rectangular shape (Example 5).

As described above, it was confirmed that suppression of variation in the distance between two cores and high foaming can be realized and it is possible to simultaneously realize an increase in transmission rate and low skew when the non-foamed skin layer having a distributed thickness, in detail, a skin layer having a larger thickness in the major axis direction than in the minor axis direction, is provided on the foamed insulation.

Modification

Figure 9:
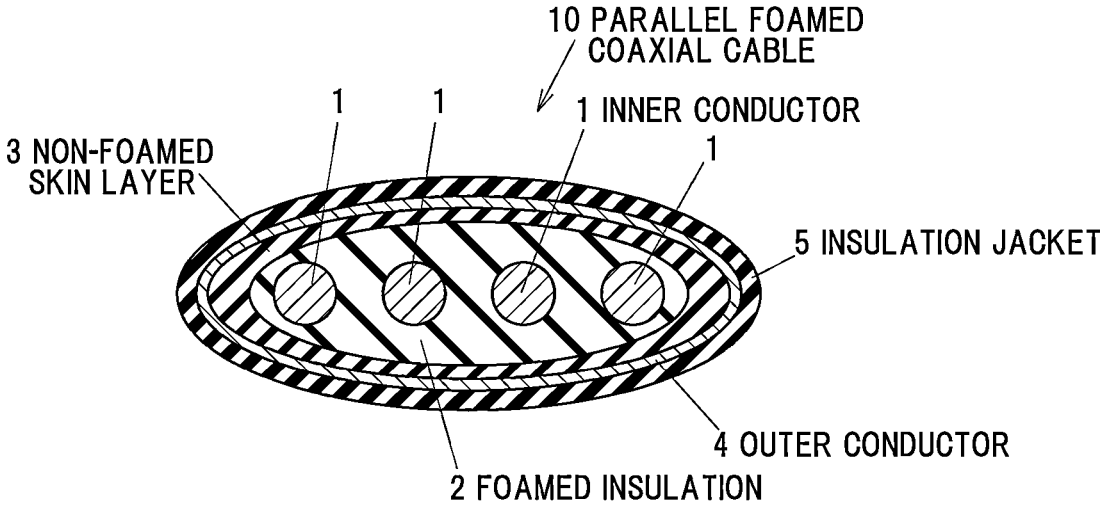
FIG. 9 is a schematic cross sectional view showing a modification using multicore parallel conductors as an inner conductor.
Figure 10:
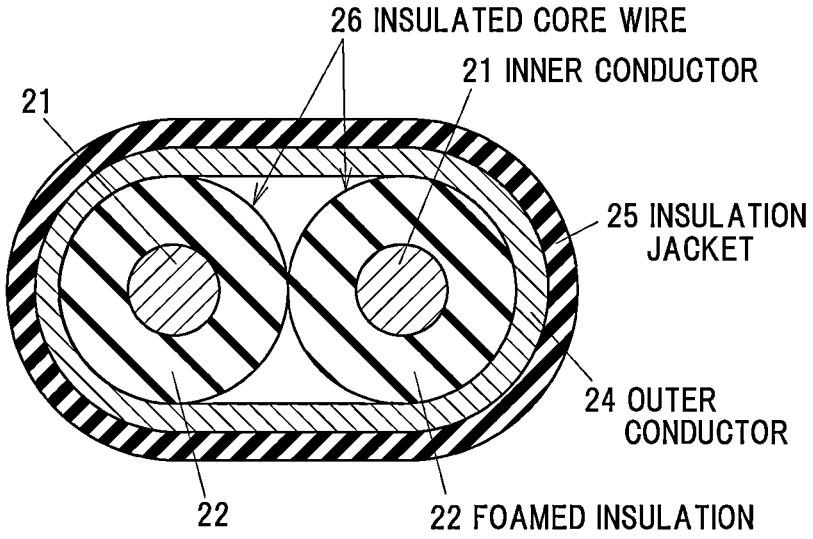
FIG. 10 is a schematic cross sectional view showing a conventional two-core parallel cable.
Figure 11:
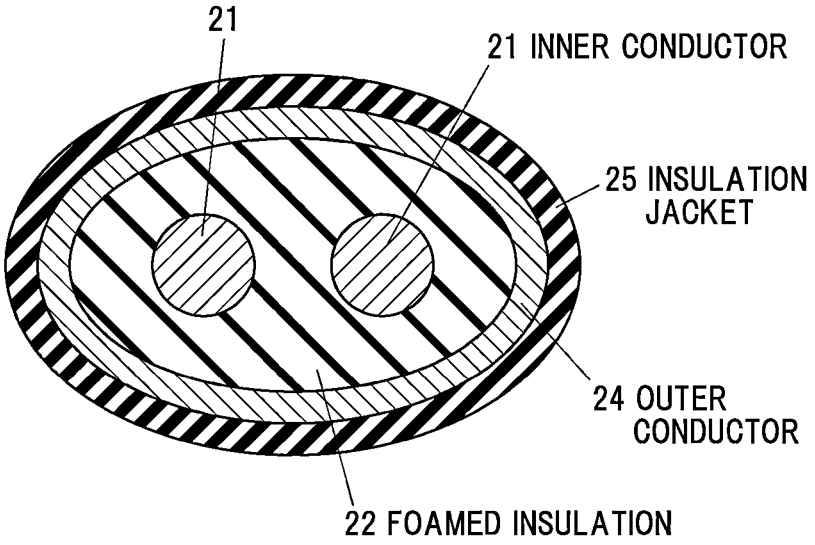
FIG. 11 is a schematic cross sectional view showing a conventional parallel foamed coaxial cable (an elliptical cross section)
Figure 12:
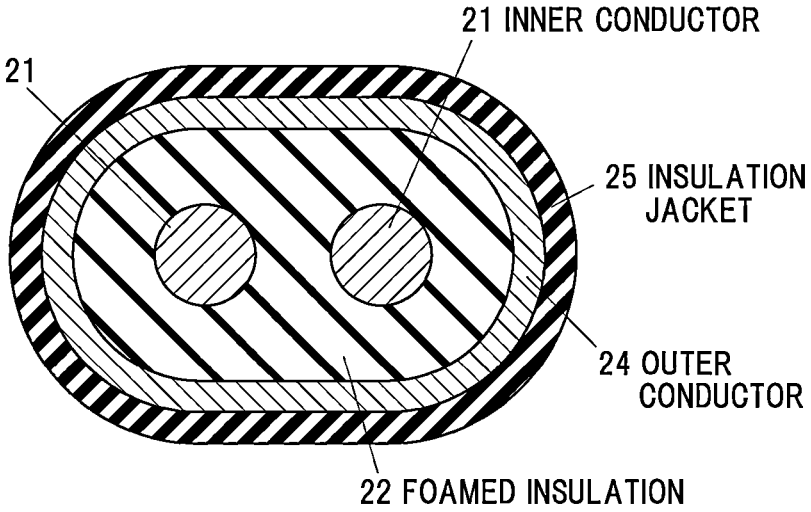
FIG. 12 is a schematic cross sectional view showing a conventional parallel foamed coaxial cable (with a rounded-rectangular cross section)
Figure 13:
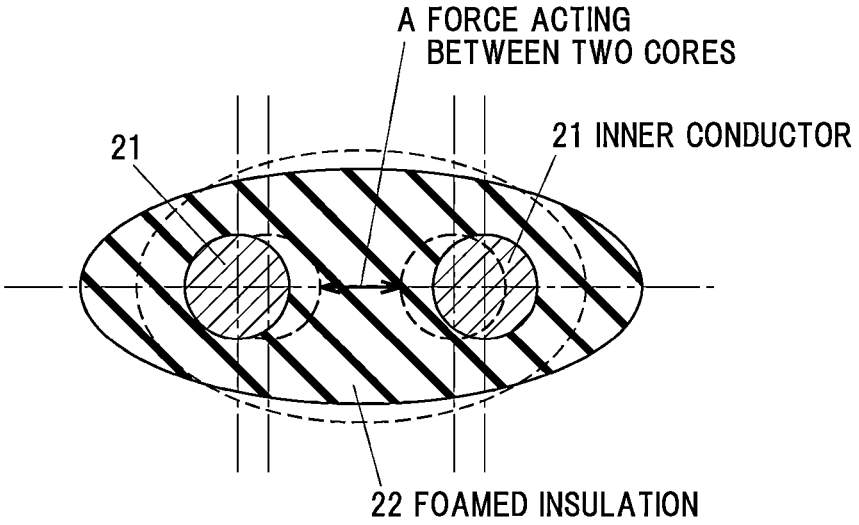
FIG. 13 is a cross sectional view showing a force generated when a portion between two cores expands due to foaming (a force acting between two cores) (indicated by an arrow A), which causes instability of the position of two cores in a parallel direction and adverse effect on impedance.
Figure 14:
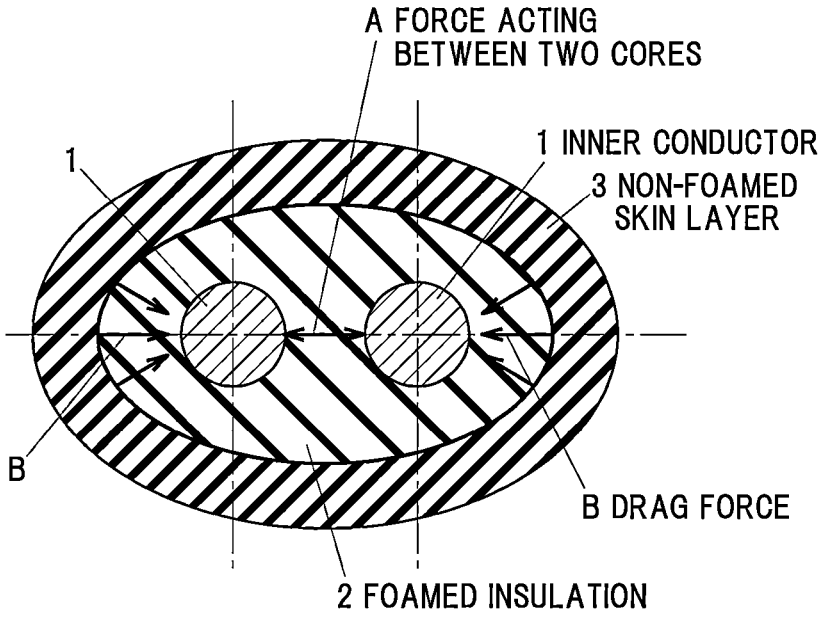
FIG. 14 is a cross sectional view showing a method of imparting a drag force (indicated by an arrow B) for suppressing expansion between two cores by providing a non-foamed skin layer.

In the invention, only the thickness in the major axis direction is large in order to fix the position of the inner conductors in a parallel direction, and the thickness in the minor axis direction is small. A configuration in which an inner conductor is multicore parallel conductor as shown in FIG. 9 is included as a modification.

Although the invention has been described with respect to the specific embodiment for complete and clear disclosure, the appended claims are not to be therefore limited but are to be construed as embodying all modifications and alternative constructions that may occur to one skilled in the art which fairly fall within the basic teaching herein set forth.

What is claimed is:

1. A parallel foamed coaxial cable, comprising:

one or more pairs of inner conductors aligned in parallel;

a foamed insulation covering together the inner conductors and having a cross sectional shape comprising an elliptical shape, a rounded-rectangular shape or a quasi-elliptical shape formed by combining a plurality of curved lines;

a non-foamed skin layer covering the foamed insulation and having a maximum thickness in a major axis direction of the cross sectional shape of the foamed insulation and a minimum thickness in a minor axis direction of the cross sectional shape of the foamed insulation;

an outer conductor covering the non-foamed skin layer; and an insulation jacket covering the outer conductor, wherein the maximum thickness of the non-foamed skin layer is not less than 1% of a major axis of the cross sectional shape of the foamed insulation such that a drag force applied by the non-foamed skin layer is sufficient along the major axis to counteract an expansion force applied by the foamed insulation covering to prevent said parallel one or more pairs of inner conductors from moving beyond a preselected distance from one another.

2. The parallel foamed coaxial cable according to claim 1, wherein the maximum thickness of the non-foamed skin layer is not less than 1% and less than 10 of the major axis of the cross sectional shape of the foamed insulation.

3. The parallel foamed coaxial cable according to claim 1, wherein the coaxial cable has an impedance variation within 100±3Ω, and a skew of not more than 3 ps/m.

4. The parallel foamed coaxial cable according to claim 1, wherein a foaming degree of the foamed insulation is 50 to 60.

5. The parallel foamed coaxial cable according to claim 1, wherein a foaming degree of the entire insulation comprising the foamed insulation and the non-foamed skin layer is 45 to 60%.

6. The parallel foamed coaxial cable according to claim 1, wherein the entire insulation comprising the foamed insulation and the non-foamed skin layer has a major axis within 3.2±0.1 mm and a minor axis within 1.6±0.1 mm.

* * * * *